US009238372B2

(12) United States Patent
Kobayashi et al.

(10) Patent No.: US 9,238,372 B2
(45) Date of Patent: Jan. 19, 2016

(54) IMAGE FORMING APPARATUS

(71) Applicants: Takeyuki Kobayashi, Kanagawa (JP); Hiroshi Noda, Kanagawa (JP); Tomomi Katoh, Kanagawa (JP)

(72) Inventors: Takeyuki Kobayashi, Kanagawa (JP); Hiroshi Noda, Kanagawa (JP); Tomomi Katoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/561,387

(22) Filed: Dec. 5, 2014

(65) Prior Publication Data

US 2015/0158308 A1 Jun. 11, 2015

(30) Foreign Application Priority Data

Dec. 10, 2013 (JP) ..... 2013-254857

(51) Int. Cl.
*B41J 2/175* (2006.01)

(52) U.S. Cl.
CPC ..... *B41J 2/17596* (2013.01)

(58) Field of Classification Search
CPC ..... B41J 2/17596
See application file for complete search history.

(56) References Cited

U.S. PATENT DOCUMENTS

| | | | | |
|---|---|---|---|---|
| 6,082,851 | A * | 7/2000 | Shihoh et al. | 347/85 |
| 6,145,971 | A * | 11/2000 | Baker et al. | 347/85 |
| 6,431,694 | B1 * | 8/2002 | Ross | 347/85 |
| 2005/0206698 | A1 * | 9/2005 | Aldrich | 347/86 |
| 2006/0268042 | A1 * | 11/2006 | Umeda | 347/19 |
| 2007/0109362 | A1 | 5/2007 | Hori et al. | |
| 2009/0058917 | A1 * | 3/2009 | Takata | 347/18 |
| 2012/0306950 | A1 | 12/2012 | Kobayashi et al. | |
| 2012/0306975 | A1 * | 12/2012 | Ohnishi | 347/94 |
| 2013/0044148 | A1 | 2/2013 | Kobayashi | |
| 2013/0057604 | A1 | 3/2013 | Masunaga et al. | |
| 2013/0057623 | A1 * | 3/2013 | Hanagami | 347/92 |
| 2013/0127937 | A1 | 5/2013 | Masunaga et al. | |
| 2013/0135368 | A1 | 5/2013 | Kobayashi et al. | |
| 2013/0135401 | A1 | 5/2013 | Kobayashi et al. | |
| 2013/0147867 | A1 | 6/2013 | Kobayashi et al. | |

FOREIGN PATENT DOCUMENTS

| | | |
|---|---|---|
| JP | 2005-059490 | 3/2005 |
| JP | 2006-021380 | 1/2006 |
| JP | 2006-021383 | 1/2006 |
| JP | 2012-056287 | 3/2012 |

* cited by examiner

*Primary Examiner* — Stephen Meier
*Assistant Examiner* — John P Zimmermann
(74) *Attorney, Agent, or Firm* — Cooper & Dunham LLP

(57) ABSTRACT

An image forming apparatus includes an apparatus body; a printhead to discharge droplets; a sub tank to hold a liquid to be supplied to the printhead for discharge as droplets; a movable carriage for scanning, including the printhead and the sub tank; a main tank to contain the liquid to be supplied to the sub tank; a liquid supply pump, disposed on the carriage, to supply the liquid from the main tank to the sub tank; a first liquid supply tube that connects the main tank to the liquid supply pump; and a second liquid supply tube that connects the liquid supply pump to the sub tank. A fluid resistance of the first liquid supply tube is greater than a fluid resistance of the second liquid supply tube. The liquid supply pump includes a deformable portion that shrinks and expands in a carriage scanning direction, by scanning movement of the carriage, to take the liquid in and pump the liquid out, and the volume of liquid supplied to the sub tank being greater than the volume of liquid supplied to the main tank when the liquid supply pump supplies the liquid to the sub tank.

20 Claims, 18 Drawing Sheets

IMAGE FORMING APPARATUS

CROSS-REFERENCE TO RELATED APPLICATIONS

The present application claims priority pursuant to 35 U.S.C. §119(a) from Japanese patent application number 2013-254857, filed on Dec. 10, 2013, the entire disclosure of which is incorporated by reference herein.

BACKGROUND

1. Technical Field

Exemplary embodiments of the present invention relate to an image forming apparatus, and more particularly, to an image forming apparatus including a printhead to discharge droplets.

2. Background Art

Among various types of image forming apparatuses, including printers, facsimile machines, copiers, plotters, and multifunction peripherals combining the capabilities of several of these devices, an inkjet recording apparatus is known in which a printhead formed of a liquid discharge head (droplet discharge head) to discharge droplets is employed.

In the thus-configured image forming apparatus, a liquid supplying device includes a sub tank to temporarily reserve the liquid to be supplied to the printhead, a main tank to contain the liquid to be supplied to the sub tank, a liquid supply tube communicating from the main tank to the sub tank, and a pump to send the liquid from the main tank to the sub tank.

Conventionally, a liquid driver is disposed at the main tank in the liquid supply tube and is driven by the movement of the printhead, so that the liquid can be supplied without providing a dedicated drive source for the liquid driver.

However, because the liquid driver is disposed at the side of the main tank, the liquid supply tube to the sub tank is long, so that a greater pressure is required to supply liquid from the main tank to the sub tank, thereby increasing the load on the carriage on which the printhead is mounted.

SUMMARY

In one embodiment of the disclosure, there is provided an improved image forming apparatus that includes an apparatus body; a printhead to discharge droplets; a sub tank to hold a liquid to be supplied to the printhead for discharge as droplets; a movable carriage for scanning, including the printhead and the sub tank; a main tank to contain the liquid to be supplied to the sub tank; a liquid supply pump to supply the liquid from the main tank to the sub tank; a first liquid supply tube that connects the main tank to the liquid supply pump; and a second liquid supply tube that connects the liquid supply pump to the sub tank. A fluid resistance of the first liquid supply tube is greater than a fluid resistance of the second liquid supply tube. The liquid supply pump includes a deformable portion that shrinks and expands in a carriage scanning direction, by scanning movement of the carriage, to take the liquid in and pump the liquid out, and the volume of liquid supplied to the sub tank being greater than the volume of liquid supplied to the main tank when the liquid supply pump supplies the liquid to the sub tank.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

First, referring to FIGS. 1A and 1B, a first embodiment of the present invention relative to an image forming apparatus will be described.

Figure 1A:
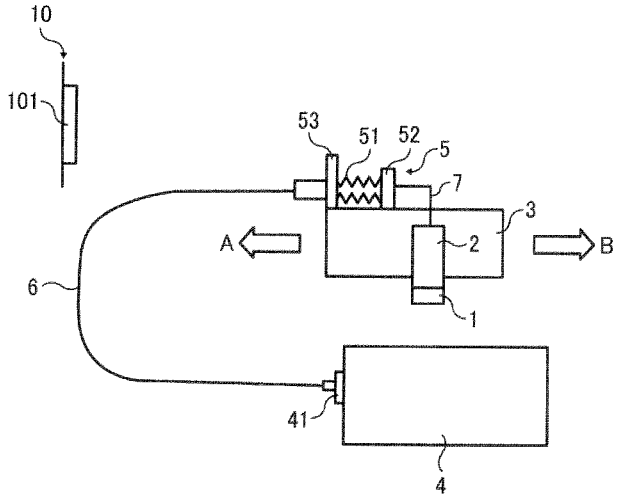
FIGS. 1A and 1B each are schematic views of a liquid supply device according to a first embodiment of the present invention.
Figure 1B:
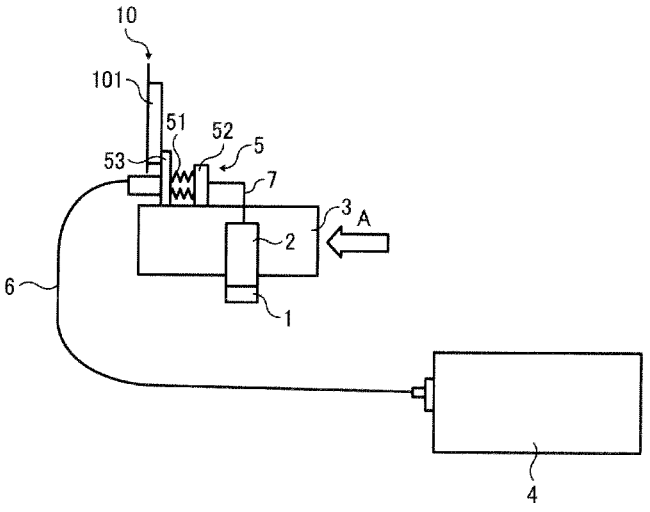

FIGS. 1A and 1B are schematic views of a liquid supply device incorporated in the image forming apparatus. The present image forming apparatus includes a printhead 1 including a liquid discharge head and a carriage 3. A head tank or sub tank 2 to reserve the liquid supplied to the printhead 1 is mounted to the carriage 3. The carriage 3 moves reciprocally back and forth laterally in what is hereinafter referred to as a carriage scanning direction.

An ink cartridge 4 is a main tank to contain a liquid to be supplied to the sub tank 2 and is detachably attached to a side of the image forming apparatus, i.e., an apparatus body 10.

The carriage 3 incorporates a liquid supply pump 5 that takes the liquid from the ink cartridge 4 and sends it to the sub tank 2.

A first liquid supply tube 6 connects the liquid supply pump 5 with the ink cartridge 4. The ink cartridge 4 is provided with an ink inlet 41, to which the first liquid supply tube 6 connects.

A second liquid supply tube 7 connects the liquid supply pump 5 with the sub tank 2.

The liquid supply pump 5 is a bellows-type pump and includes a pump casing to contain the liquid in an interior thereof, and is formed of a bellows portion 51 which is expandably collapsible in the carriage scanning direction (i.e., in the directions indicated by arrows A and B).

One edge of the bellows portion 51 of the liquid supply pump 5 is attached to a fixed portion 52 mounted on the carriage 3 and the other edge of the bellows portion 51 is attached to a movable portion 53.

A contact 101 is disposed on the apparatus body 10. When the carriage 3 moves in the direction of arrow A, the movable portion 53 of the liquid supply pump 5 abuts and is pressed against the contact 101.

When the carriage 3 moves in the direction of arrow A and the movable portion 53 of the liquid supply pump 5 abuts the contact 101 of the apparatus body 10 side and is pressed, the movable portion 53 of the liquid supply pump 5 is pressed in a direction opposite the direction indicated by arrow A, that is, toward an arrow B direction, collapsing the bellows portion 51 and reducing an interior volume thereof to pump liquid out of the liquid supply pump 5.

Then, when the carriage 3 moves reciprocally in the direction of arrow A and in the direction of arrow B, the movable portion 53 of the liquid supply pump 5 separates from the contact 101 on the apparatus body 10 side. With this structure, the bellows portion 51 expands and the internal volume increases, so that the liquid is drawn to the liquid supply pump 5.

Thus, the liquid supply pump 5, the bellows part of which is collapsible by the scanning of the carriage 3, that is, the bellows portion 51 herein, is deformed, so that the interior volume changes and the liquid is expelled.

Herein, a fluid resistance of the first liquid supply tube 6 that connects the liquid supply pump 5 to the ink cartridge 4 is larger than that of the second liquid supply tube 7 that connects the liquid supply pump 5 to the sub tank 2.

Herein, the first liquid supply tube 6 and the second liquid supply tube 7 are both formed of the same tube and the cross-sectional areas of the both in the direction perpendicular to the direction in which the liquid flows are the same or substantially the same. Further, the first liquid supply tube 6 is longer than the second liquid supply tube 7, and the fluid resistance of the first liquid supply tube 6 is larger than that of the second liquid supply tube 7.

In this case, by mounting the liquid supply pump 5 to the carriage 3, the first liquid supply tube 6 is made longer than that of the second liquid supply tube 7 so that the fluid resistance of the first liquid supply tube 6 is greater than that of the second liquid supply tube 7.

Accordingly, when the carriage 3 is scanned in the direction of arrow A as illustrated in FIG. 1A, the movable portion 53 of the liquid supply pump 5 abuts and is pressed against the contact 101 on the apparatus body 10 as illustrated in FIG. 1B.

When the carriage 3 further moves in the direction of arrow A, the movable portion 53 moves to the direction opposite the direction indicated by arrow A, the bellows portion 51 contracts and the interior volume thereof is reduced, so that the liquid is sent out from the interior of the liquid supply pump 5 to the sub tank 2.

In this case, because the fluid resistance of the first liquid supply tube 6 is larger than that of the second liquid supply tube 7, the volume of liquid supplied to the sub tank 2 to which the second liquid supply tube 7 connects becomes larger than the volume of liquid supplied of the ink cartridge 4 or the main tank.

Herein, the volume of ink to be supplied to the sub tank 2 needs to be more than the amount discharged from the printhead 1 while the carriage moves to-and-fro once. Accordingly, pressure to supply a predetermined volume of liquid from the liquid supply pump 5 to the sub tank 2 is required.

The pressure to supply a predetermined volume of liquid is different depending on the fluid resistance of the supply tube through which the liquid is supplied. As the fluid resistance of the supply tube increases, the pressure to supply the liquid needs to be increased; however, if the fluid resistance is minimal, the pressure may be small.

Here, the fluid resistance of the supply tube becomes smaller when the cross-sectional area of the supply tube is larger or the length of the supply tube is shorter.

However, when the cross-sectional area of the supply tube is larger, because the ink inside the supply tube does not exert enough tension over an internal periphery of the supply tube, a meniscus is not formed sufficiently. If the meniscus is not formed, a layer mixed with air and ink is formed inside the supply tube. The air inside the supply tube is kept in the supply tube, and causes the ink inside the supply tube to be viscous or coagulate.

In addition, when the air kept in the supply tube expands or contracts due to changes in the temperature around the image forming apparatus, pressure inside the supply tube changes, thereby causing an ink leakage from the discharge head or air to be mixed in the supply tube.

In addition, when the cross-sectional area of the supply tube is large, the ink is not supplied uniformly in the same direction and disturbed flows occur, thereby degrading liquid supply efficiency.

As a result, increasing the cross-sectional area of the supply tube to reduce the fluid resistance has its own limits.

In the present embodiment, however, by mounting the liquid supply pump 5 on the carriage 3, the fluid resistance of the second liquid supply tube 7 formed with a supply tube from the liquid supply pump 5 to the sub tank 2 can be reduced compared to a case in which the liquid supply pump 5 is mounted to the side of the apparatus body 10.

With this structure, a predetermined volume of liquid can be supplied with a small amount of pressure and accordingly the load on the carriage when supplying liquid during the carriage scanning can be reduced. Further, the problem of ink leakage from the liquid supply tube to the outside the image forming apparatus when the liquid expelling pressure is large, thereby damaging the image forming apparatus, is solved.

Figure 2:
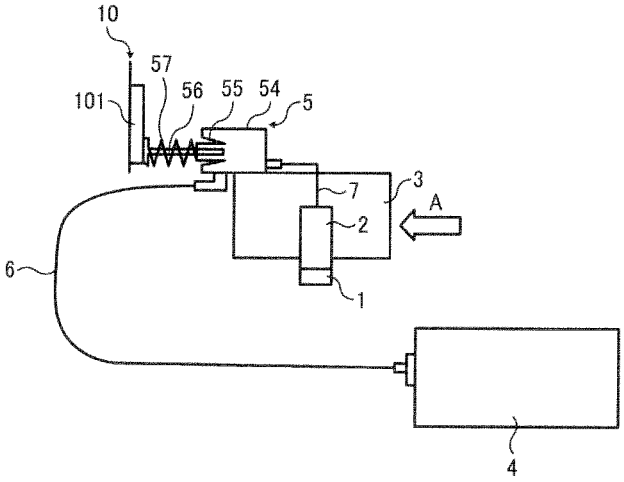
FIG. 2 is a schematic view of a liquid supply device according to a second embodiment of the present invention.

Next, referring to FIG. 2, a second embodiment of the present invention will be described. FIG. 2 is a schematic view of the image forming apparatus.

In the second embodiment, a piston pump is used as a liquid supply pump 5. One opening of the liquid supply pump 5 in the carriage scanning direction of a pump casing 54 is closed by a wall portion 55 which is collapsible in the main scanning direction. The pump casing 54 serves as a liquid container. A rod 56 serves as a pressing member. The rod 56 is mounted to the wall portion 55, and a restoring spring 57 to press the rod 56 outwards is disposed.

The liquid supply pump 5 is configured such that, when the carriage 3 scans, the rod 56 abuts the contact 101 on the apparatus body 10 and is pressed against it, so that the rod 56 is depressed. As a result, the wall portion 55 is pressed to an interior of the pump casing 54, and an internal volume declines and the liquid inside the pump casing 54 is expelled.

When the carriage 3 further moves to scan in the direction opposite the direction indicated by arrow A, the contact 101 on the apparatus body 10 and the rod 56 are separated, the restoring spring 57 moves to expand the internal volume, and the liquid is drawn into the pump casing 54.

With this configuration as well, the same effect as that of the first embodiment can be obtained.

Next, a third embodiment according to the present invention will be described with reference to FIGS. 3 and 4.

Figure 3:
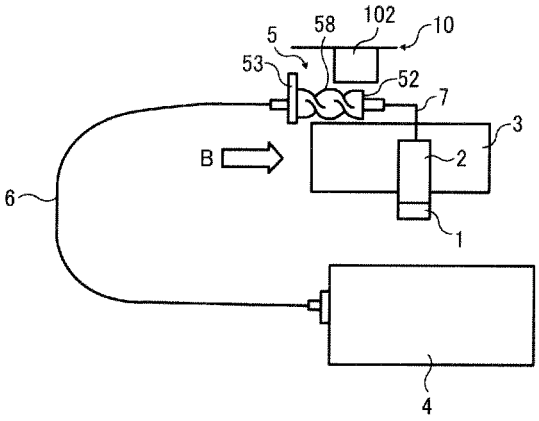
FIG. 3 is a schematic view of a liquid supply device according to a third embodiment of the present invention.
Figure 4A:
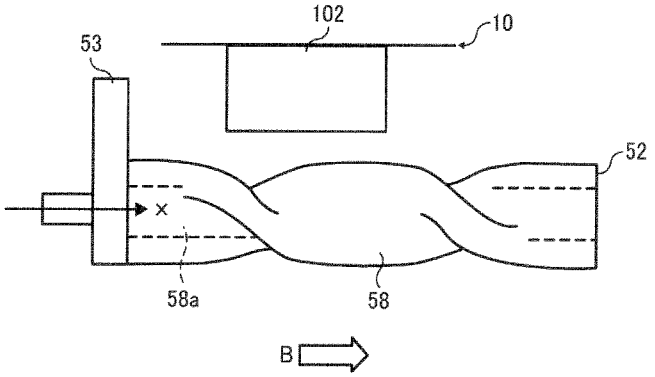
FIGS. 4A and 4B are schematic explanatory views each illustrating an operation of a liquid supply pump according to the third embodiment of the present invention.
Figure 4B:
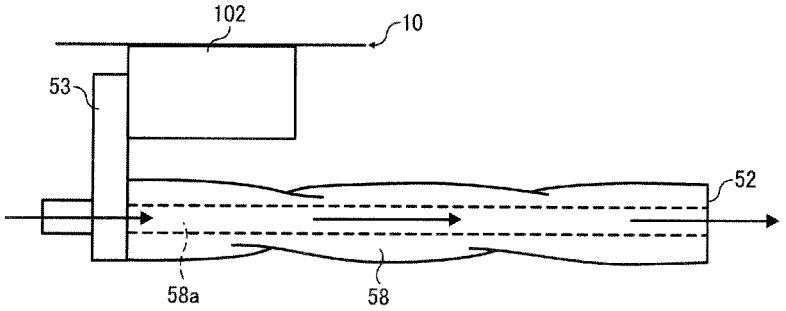

FIG. 3 is a schematic explanatory view illustrating the third embodiment; and FIGS. 4A and 4B are schematic explanatory views each illustrating an operation of the liquid supply pump.

The liquid supply pump 5 of the third embodiment includes a twisted portion 58, which is twisted in an initial state and formed in a contracted state but is expandably collapsible when extended. The twisted portion 58 includes a fluid passage 58*a* to allow passage of fluid therethrough. A movable portion 53 to also serve as a pressing portion is disposed at one end of the twisted portion 58, and a fixed portion 52 is disposed at the other end thereof.

The liquid supply pump 5 is configured such that, when the movable portion 53 does not abut a contact 102 on the apparatus body 10 as illustrated in FIG. 4A, the twisted portion 58 is twisted due to the resilience force and the fluid passage 58*a* is closed (see a mark x in FIG. 4A).

When the carriage 3 scans in the direction of arrow B as illustrated in FIG. 4A, the movable portion 53 of the liquid supply pump 5 abuts and is pressed against the contact 102 on the apparatus body 10. Due to a further scan of the carriage 3, as illustrated in FIG. 4B, the twisted portion 58 extends, the fluid passage 58*a* inside the twisted portion 58 is released, and ink is drawn into the fluid passage 58*a*.

Thereafter, when the carriage 3 scans in the direction opposite the arrow B direction, the movable portion 53 separates from the contact 102 on the apparatus body 10 and contracts to an initial twisted state, and the ink inside the fluid passage 58*a* is sent out toward the sub tank 2.

Specifically, in the present embodiment, when the twisted portion 58 first extends and contracts afterward, liquid can be fed out.

With this configuration as well, the same effect as that of the first embodiment can be obtained.

Next, referring to FIG. 5, a fourth embodiment of the present invention will be described.

Figure 5:
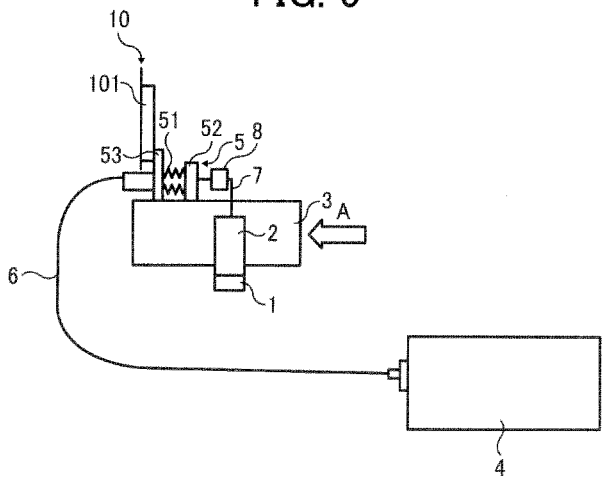
FIG. 5 is a schematic view of a liquid supply device according to a fourth embodiment of the present invention.

FIG. 5 is a schematic view of the liquid supply device according to a fourth embodiment of the present invention. In the present embodiment, a one-way valve 8 is disposed on the second liquid supply tube 7 communicating the liquid supply pump 5 with the sub tank 2. The one-way valve 8 stops passage of the liquid from the sub tank 2 to the liquid supply pump 5. A first liquid supply tube 6 and connects the liquid supply pump 5 with the ink cartridge 4, does not include a one-way valve.

With this structure, reverse passage of the liquid that has been sent to the sub tank 2 is prevented from returning to the liquid supply pump 5 due to the difference in the fluid resistance between the first liquid supply tube 6 and the second liquid supply tube 7, thereby making pumping more effective.

In this case, the one-way valve need not be provided to the first liquid supply tube 6 because the liquid supply is performed using the difference in the fluid resistance between the first liquid supply tube 6 and the second liquid supply tube 7 by increasing the fluid resistance of the first liquid supply tube 6.

Figure 6:
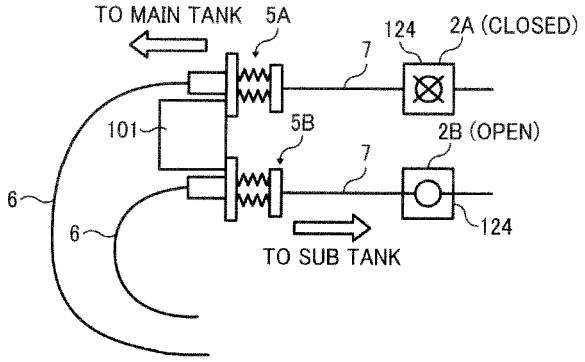
FIG. 6 is a schematic view of a liquid supply device according to a fifth embodiment of the present invention.

Next, a fifth embodiment of the present invention will be described with reference to FIGS. 6 and 7. FIG. 6 is a schematic explanatory view illustrating the fifth embodiment; and FIG. 7 is a schematic explanatory view illustrating a sub tank.

The sub tank 2 of the present embodiment includes an automatic valve. The automatic valve automatically opens or closes corresponding to an increase of an inside negative pressure due to liquid or ink consumption by the printhead 1 and a decrease of an inside negative pressure due to a liquid or ink supply.

Figure 7:
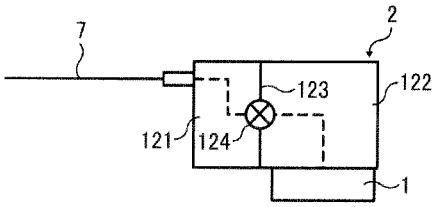
FIG. 7 is a schematic view of a sub tank in FIG. 6.

Specifically, as illustrated in FIG. 7, the sub tank 2 includes a main pressure chamber 121 communicating to the second liquid supply tube 7 and a negative pressure chamber 122 separated from the main pressure chamber 121 via a partition 123 and communicating to the printhead 1. Then, a part of the partition 123 is provided with an automatic valve 124 that connects or separates the positive pressure chamber 121 and the negative pressure chamber 122.

The automatic valve 124 opens when ink is discharged from the printhead 1, the ink amount inside the sub tank 2 is reduced, the negative pressure inside the negative pressure chamber 122 increases, and the ink amount becomes less than a predetermined ink amount, that is, when the negative pressure inside the negative pressure chamber 122 becomes more than a predetermined pressure amount. When the automatic valve 124 opens, ink flows from the positive pressure chamber 121 with a higher positive pressure than the negative pressure chamber 122, to the negative pressure chamber 122 and the negative pressure in the negative pressure chamber 122 decreases. As a result, the ink amount in the negative pressure chamber 122 exceeds a predetermined ink amount, that is, the negative pressure is reduced to less than a predetermined pressure, the automatic valve 124 closes.

In this case, even after the automatic valve 124 opens, ink is not supplied and ink discharge continues, and the ink amount inside the sub tank 2 becomes less than a predetermined lower limit. When the ink amount inside the sub tank 2 becomes less than the predetermined lower limit, the negative pressure in the negative pressure chamber 122 becomes high and air is drawn from the nozzle of the printhead 1, thereby causing defective discharge or ink leakage. As a result, caution should be paid lest the ink amount inside the sub tank 2 becomes less than the predetermined lower limit.

As illustrated in FIG. 6, the image forming apparatus according to the fifth embodiment includes a plurality of sub tanks 2A, and 2B each having an automatic valve 124, and a plurality of liquid supply pumps 5A, and 5B to pump liquid to the plurality of sub tanks 2A, and 2B.

In addition, a contact 101 to which each movable portion 53 of the plurality of liquid supply pumps 5A, and 5B is pressed, is disposed on the apparatus body 10.

Herein, suppose that one sub tank 2A contains ink more than the predetermined ink amount and the automatic valve 124 thereof is closed, and that the other sub tank 2B contains ink less than the predetermined ink amount and the automatic valve 124 is open.

In this state, when the carriage 3 moves to scan, each movable portion 53 of the liquid supply pumps 5A, and 5B abuts the contact 101 and pressed. In this state, ink is supplied from the liquid supply pump 5B of the sub tank 2B with the automatic valve 124 open, to the sub tank 2B, and ink is further sent from the liquid supply pump 5A of the sub tank 2A side with the automatic valve 124 closed, to the ink cartridge 4.

With the structure having the sub tanks each having an automatic valve and without a one-way valve on the supply tube between the main tank and the liquid supply pump, a plurality of quid supply pumps is simultaneously driven regardless of ink amount inside the sub tank.

With this structure, there is no need of providing a plurality of contacts disposed on the apparatus body 10 to drive an individual liquid supply pump, and the drive unit of the liquid supply pump is implemented by a simple structure.

Figure 8:
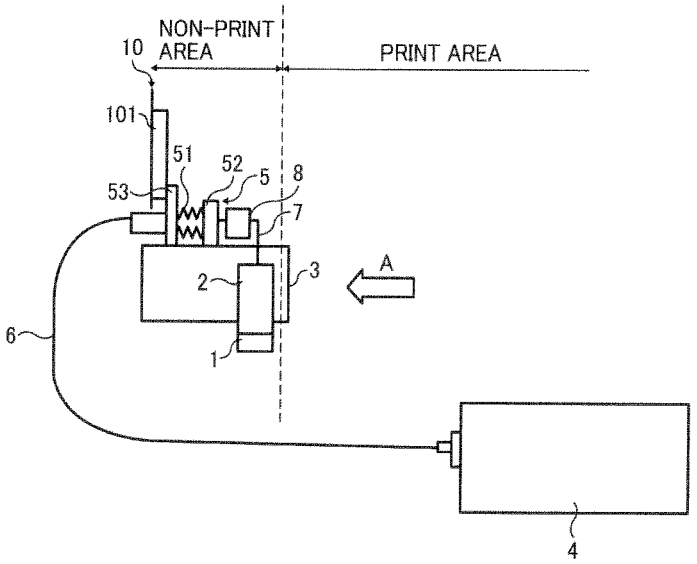
FIG. 8 is a schematic view of a liquid supply device illustrating a liquid supply position according to a sixth embodiment of the present invention.

Next, referring to FIG. 8, a sixth embodiment of the present invention will be described. FIG. 8 is a schematic explanatory view of the liquid supply device illustrating a liquid supply position according to the sixth embodiment of the present invention;

When liquid supply operation is performed by pressing the movable portion 53 of the liquid supply pump 5 disposed on the carriage 3 toward the contact 101 of the side of the apparatus body 10, there is a possibility that the pressure of the movable portion 53 of the liquid supply pump 5 may adversely affect the operation of the carriage 3 under scanning movement.

Then, the movable portion 53 of the liquid supply pump 5 is pressed toward the contact 101 of the apparatus side at a non-print area (where the to-be-recorded medium is not opposed) during the liquid supply operation With this structure, even though the carriage 3 moves unreliably when the movable portion 53 of the liquid supply pump 5 is pressed toward the contact 101 of the side of the apparatus body 10, which does not adversely affect the image quality.

Figure 9:
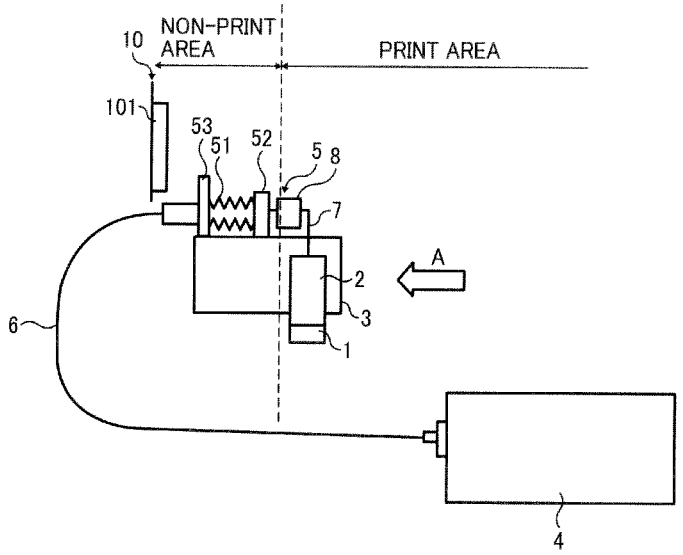
FIG. 9 is a schematic view of a liquid supply device illustrating a liquid supply position according to a seventh embodiment of the present invention.

Next, referring to FIG. 9, a seventh embodiment of the present invention will be described. FIG. 9 is a schematic explanatory view of the liquid supply device illustrating a liquid supply operation according to the seventh embodiment of the present invention.

In the sixth embodiment described above, if the liquid supply operation is performed such that the carriage 3 scans to move up to the non-print area in each and every scanning operation, even though the liquid supply operation is performed, there occurs a case in which ink is not supplied to the sub tank 2 having an automatic valve 124 according to the fifth embodiment.

For example, when an image with an image size narrower than the width of the print area and a low coverage rate that can be printed with a small amount of ink is printed, the ink amount to be discharged from the printhead 1 during one reciprocal movement of the carriage 3 is small.

In this case, even when the liquid supply operation can be performed, if the ink amount inside the sub tank 2 is sufficient and exceeds the predetermined amount, the liquid supply operation to move the carriage 3 to the non-print area is useless because the automatic valve 124 of the sub tank 2 is closed.

Accordingly, in the seventh embodiment, a consumed amount measuring device is disposed, which measures a consumed amount of the liquid in the sub tank 2 based on the droplet discharge amount from the printhead 1.

The measuring device measures the discharged ink amount during the carriage 3 scans, and when the consumed amount of the liquid exceeds the predetermined amount based on the measurement result, the carriage 3 is caused to scan and the liquid supply operation is performed.

For example, when the consumed amount of the liquid discharged from the printhead 1 during the carriage 3 scans is less than the predetermined amount, that is, the residual ink amount inside the sub tank 2 is more than the predetermined residual amount, as illustrated in FIG. 9, without moving the carriage 3 until the movable portion 53 of the liquid supply pump 5 abuts the contact 101 on the apparatus body 10 side, and without performing the liquid supply operation, the printing operation continues.

By contrast, when the consumed amount of the liquid discharged from the printhead 1 during the carriage 3 scans is more than the predetermined amount, that is, the residual ink amount inside the sub tank 2 is less than the predetermined residual amount, the carriage 3 is allowed to move to the non-print area and ink is replenished in the sub tank 2 by performing the liquid supplying operation.

Thus, only when the ink supply is required, the carriage is allowed to move to the non-print area and perform the ink supply operation, so that an efficient image forming operation can be performed.

Figure 10:
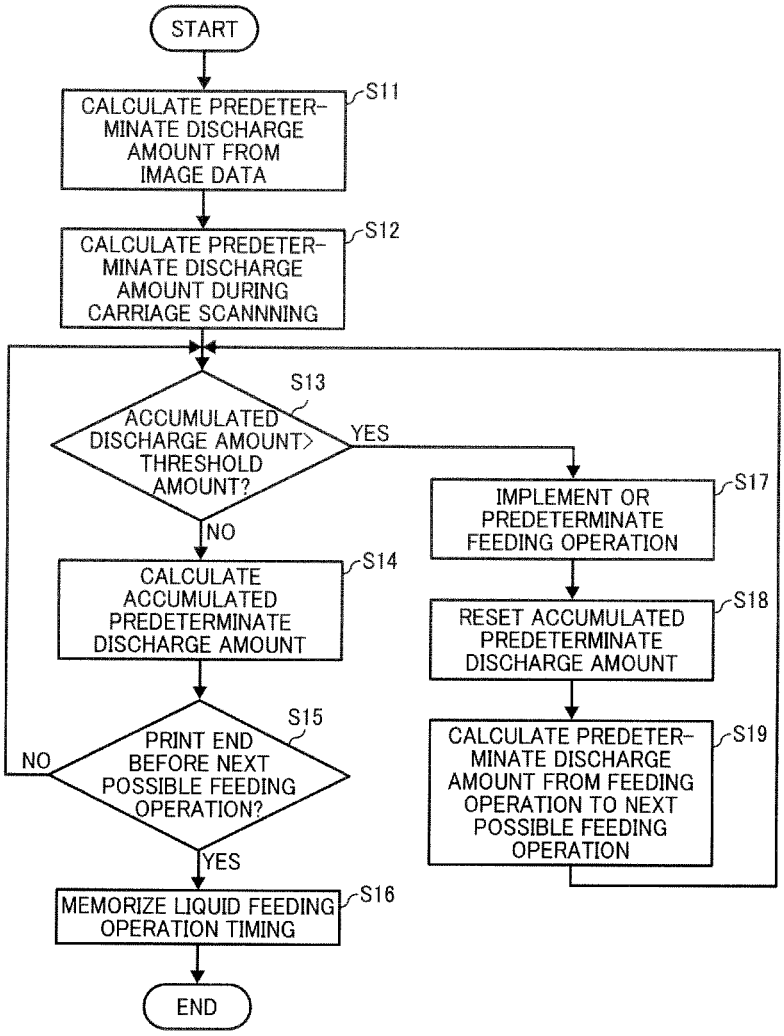
FIG. 10 is a flowchart of a liquid supply operation according to an eighth embodiment of the present invention.

Next, an eighth embodiment according to the present invention will be described with reference to FIG. 10. FIG. 10 is a flowchart of a liquid supply operation according to the eighth embodiment of the present invention.

In the eighth embodiment, before starting to form an image, an ink discharge amount required to form an image is previously calculated based on image data (in Step S11).

Then, the predetermined discharge amount (that is, the accumulated discharge amount) during the carriage scanning from the start of printing to a state in which a liquid supply operation becomes possible, that is, the carriage 3 is moved to scan up to the position where the movable portion 53 of the liquid supply pump 5 presses the contact 101 on the apparatus body 10 (S12).

Thereafter, whether or not the accumulated discharge amount exceeds the threshold amount is determined (S13).

Herein, if the accumulated discharge amount is not more than the threshold amount (NO in S13), the accumulated discharge amount until the next liquid supply/supplying operation becomes possible is calculated (S14).

Then, whether the printing ends or not before the next liquid supply operation becomes possible is determined (S15). If the printing does not end before the next liquid supply operation becomes possible (NO in S15), the process returns to Step S13 in which it is determined whether or not the accumulated discharge amount exceeds the threshold amount. By contrast, if the printing ends before the next liquid supply operation becomes possible (YES in S15), the timing of the liquid supply operation is stored in memory (S16) and the process ends.

On the other hand, when the accumulated discharge amount exceeds the threshold amount (YES in S13), the liquid supply operation is performed or the liquid supply operation is predetermined (S17). Then, the accumulated, predetermined discharge amount is reset (S18). The predetermined discharge amount from the start of the liquid supply operation until the next possible liquid supply operation is calculated (S19), and the process returns to the Step S13 in which it is determined whether or not the predetermined accumulated discharge amount exceeds the threshold amount.

Specifically, in the present embodiment, the residual ink amount inside the sub tank 2 at a time when the carriage 3 scans to move to a position where the liquid supply operation is possible, is forecasted, and the timing to perform the liquid supply operation is determined.

For example, if the predetermined, accumulated discharge amount while the carriage 3 scans to move, from the start of printing, to a position where the liquid supply operation is performed, is more than the threshold amount, the liquid supply operation is performed.

Herein, the threshold ink amount means a dischargeable ink amount that is not less than the predetermined lower limit of the ink amount. If the ink amount is below the predetermined lower limit, when the ink is discharged, the negative pressure inside the sub tank 2 increases greatly due to ink consumption inside the sub tank 2, so that air mixes in from the nozzle.

In addition, even when the predetermined, accumulated discharge amount is less than the threshold ink amount, the liquid supply operation is performed when the accumulated predetermined discharge amount discharged during the carriage to-and-fro scanning movement until the next liquid supply operation becomes possible, is more than the threshold ink amount.

After the liquid is supplied in the liquid supply operation, the accumulated predetermined discharge amount until implementation of the liquid supply operation is reset, and again, the predetermined discharge amount to be discharged during the to-and-fro scanning movement until the next liquid supply operation becomes possible is calculated. When the calculated predetermined discharge amount is more than the threshold ink amount, the liquid supply operation is performed after the next to-and-fro scanning movement.

It is noted that, before the start of the printing operation, every timing of the liquid supply operation during the printing can be determined in advance; or alternatively, the timing of the liquid supply operation can be determined during printing.

Figure 11:
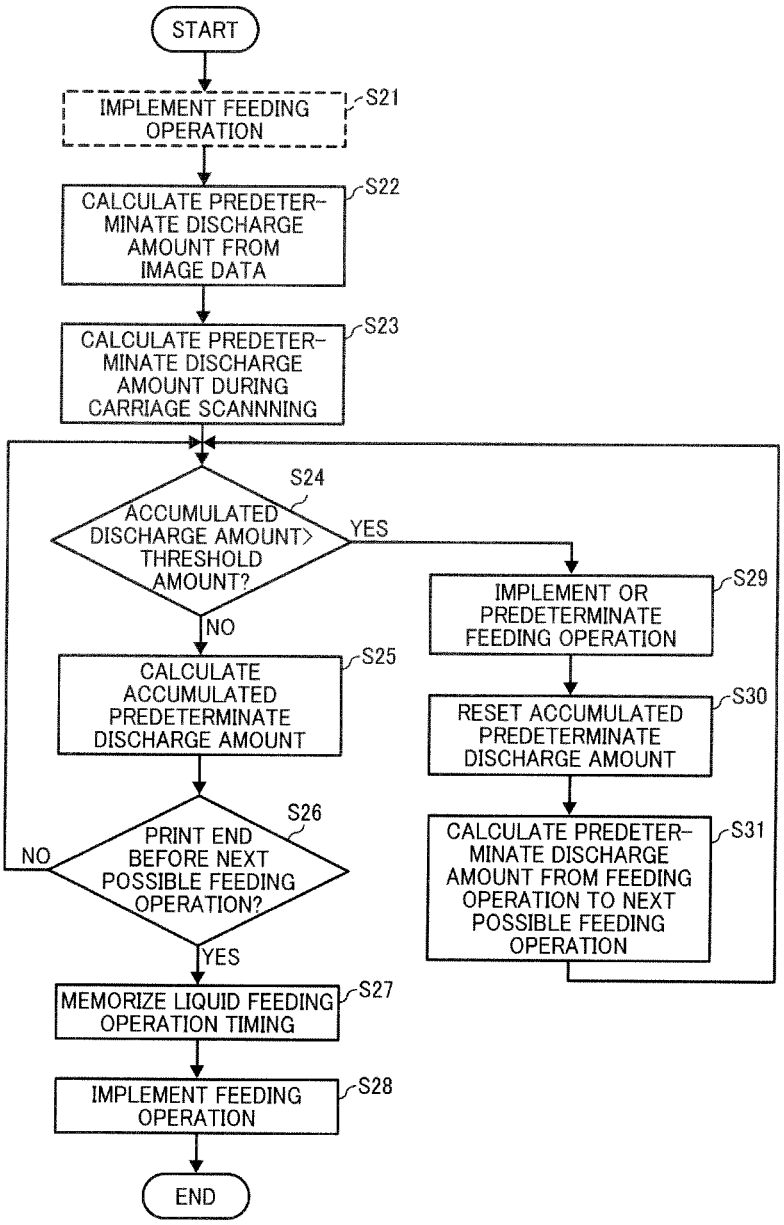
FIG. 11 is a flowchart of a liquid supply operation according to a ninth embodiment of the present invention.

Next, a ninth embodiment according to the present invention will be described with reference to FIG. 11. FIG. 11 is a flowchart of a liquid supply operation according to the ninth embodiment of the present invention.

In the present embodiment, the liquid supply operation is performed regardless of the ink amount inside the sub tank 2 after printing operation. For example, the liquid supply operation is performed until the automatic valve 124 of the sub tank 2 closes in which the ink in the sub tank 2 is full, and the printing operation starts from a state in which the sub tank 2 is full of ink (S28).

Or alternatively, as in Step S21 as illustrated by a broken line, the printing operation is set to start after performing the liquid supply operation before the start of printing.

With this configuration, any time the printing operation is started, the sub tank 2 is full of ink constantly. Steps from S22 to S27, and S29 to 31 are the same as the Steps from S11 to S16, and S17 to 19, respectively, so that the redundant description will be omitted.

Figure 12:
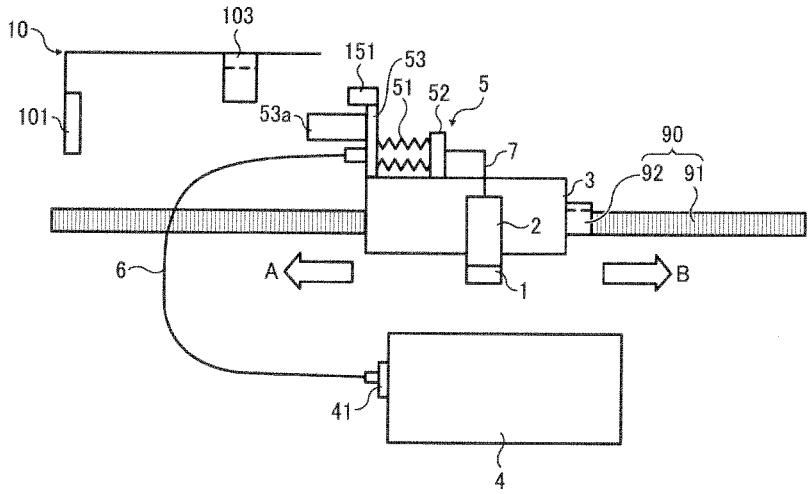
FIG. 12 is a schematic view of a liquid supply device according to a tenth embodiment of the present invention.

Next, a tenth embodiment according to the present invention will be described with reference to FIG. 12. FIG. 12 is a schematic view of the liquid supply device in the image forming apparatus according to the tenth embodiment of the present invention.

The present embodiment enables the apparatus to detect a residual ink amount inside the main tank.

Specifically, a linear encoder 90 including an encoder sheet 91 and an encoder sensor 92 to read out the encoder sheet 91 is disposed along the moving direction of the carriage 3, so that the linear encoder 90 is configured to detect a position of the carriage 3.

In addition, the movable portion 53 of the liquid supply pump 5 includes a pressing portion 53*a* that presses the contact 101 on the apparatus body 10, and a feeler 151.

On the other hand, on the side of the apparatus body 10, a feeler sensor 103 to detect the feeler 151 of the liquid supply pump 5 is disposed.

Figure 13:
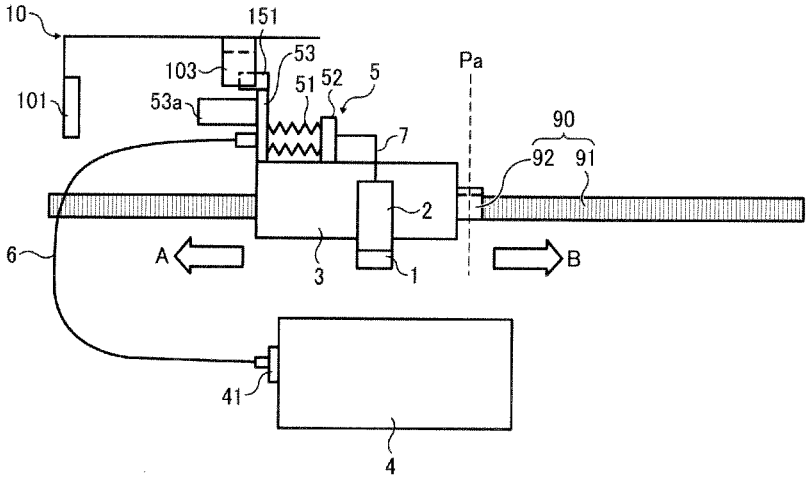
FIG. 13 is a schematic view of the liquid supply device illustrating a carriage position detection operation when ink remains in residual ink amount detection operation according to the tenth embodiment of the present invention.
Figure 14:
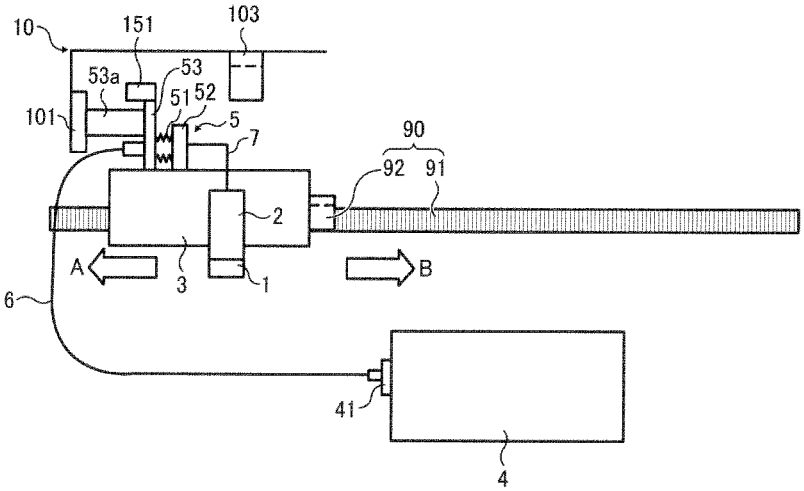
FIG. 14 is a schematic explanatory view of the liquid supply operation in the tenth embodiment of the present invention.
Figure 15:
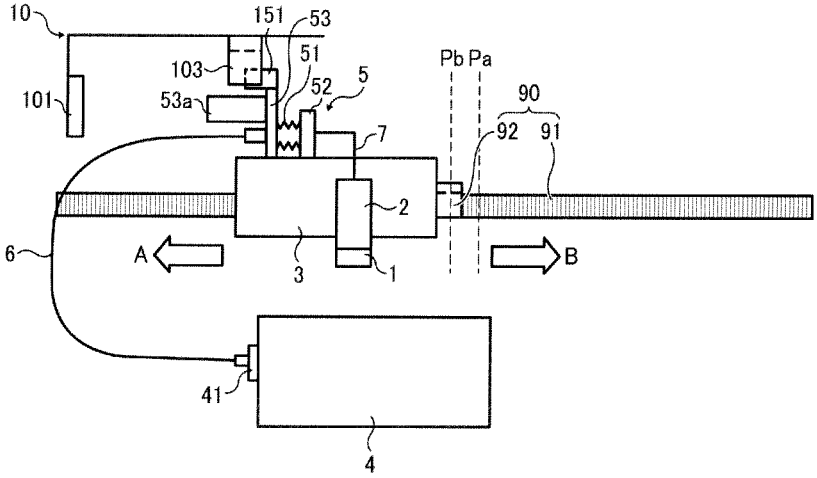
FIG. 15 is a schematic explanatory view of the carriage position detection operation of the tenth embodiment of the present invention.

Next, the residual ink amount detection operation according to the tenth embodiment will be described with reference to FIGS. 13 through 15. FIG. 13 is a schematic view of the liquid supply device illustrating a carriage position detection operation when ink remains; FIG. 14 is a schematic view illustrating the liquid supply operation; and FIG. 15 is also a schematic view illustrating the carriage position detection operation.

As illustrated in FIG. 13, when the ink inside the ink cartridge 4 remains sufficiently, the carriage 3 moves in the direction of an arrow A. Then, a position of the carriage (hereinafter, "a carriage position Pa") when the feeler sensor 103 detects the feeler 151 of the liquid supply pump 5 is detected by the linear encoder 90, and the carriage position Pa is stored in the internal memory means.

In the present embodiment, when the residual ink amount is enough, the liquid supply operation is performed once and the carriage 3 is moved in the direction of an arrow B that is opposite the direction indicated by arrow A, and thereafter, the carriage 3 is moved in the direction of arrow A again and the carriage position Pa is detected.

Accordingly, when the carriage 3 is scanned in the direction of arrow A as illustrated in FIG. 14, the movable portion 53 of the liquid supply pump 5 abuts and is pressed against the contact 101 on the apparatus body 10. With this structure, the movable portion 53 moves and the bellows portion 51 contracts, so that the ink is supplied out.

Thereafter, when the carriage 3 is moved in the direction of arrow B opposite the direction indicated by arrow A, the pressing portion 53*a* of the movable portion 53 of the liquid supply pump 5 separates from the contact 101 attached to the apparatus body 10, so that the contracted bellows portion 51 of the liquid supply pump 5 tends to return to its original shape.

In this time, as to the sub tank 2 configured to include an automatic valve 124 as described above, the automatic valve 124 is closed due to the liquid supply operation even when the bellows portion 51 tends to return to its original shape, the ink is not drawn from the sub tank 2 but from the ink cartridge 4, and the bellows portion 51 returns to its original shape.

Similarly, as to the sub tank 2 according to the fourth embodiment, the one-way valve 8 is disposed on the second liquid supply tube 7 communicating the liquid supply pump 5 with the sub tank 2. The one-way valve 8 stops passage of the liquid from the sub tank 2 to the liquid supply pump 5, so that the bellows portion 51 returns to its original shape by drawing the ink from the ink cartridge 4.

As described above, after the liquid supply operation, when the carriage 3 scans in the direction of arrow B separating from the contact 101 on the apparatus body 10, the contracted bellows portion 51 returns to its original shape.

However, if there is no residual ink inside the ink cartridge 4, ink is not drawn into the liquid supply pump 5, so that the bellows portion 51 remains contracted and does not return to its original shape.

Then, after the carriage 3 moves back in the direction of arrow B after the liquid supply, when the carriage 3 moves again in the direction of arrow A as illustrated in FIG. 15, the feeler sensor 103 detects the feeler 151 of the liquid supply pump 5 at a carriage position nearer to the contact 101 on the apparatus body 10 than the stored in memory carriage position Pa. The carriage position of the carriage 3 detected by the encoder 90 is referred to as a "carriage position Pb."

Specifically, a displacement amount or an amount of change between the stored in memory carriage position Pa when there is residual ink in the ink cartridge 4 and the carriage position Pb after the ink has been consumed is calculated, the change amount is compared with a predetermined threshold amount corresponding to a state in which there is no ink, so that no residual ink state can be detected.

As described above, in the present embodiment, whether or not a collapsible portion of the liquid supply pump expands after the liquid supply operation is performed by contracting the collapsible portion of the liquid supply pump, is detected by the variation of the amount of change between the carriage position Pa at a time or normal recovery and the carriage position Pb detected after the liquid supply operation by the liquid supply pump has been performed, that is, after the liquid has been consumed, thereby detecting the residual liquid amount inside the main tank.

As a result, when the carriage position Pa when the feeler sensor detects the feeler is detected as a state in which there is residual ink in the main tank and is stored in memory, the carriage position Pa is preferably detected and stored in memory after the pressing portion 53*a* of the liquid supply pump 5 is pressed to the contact 101 on the apparatus body 10 and the liquid is sent once.

In addition, in the present embodiment, the feeler sensor 103 can be disposed at any position within the carriage scanning area. However, the time to take from when the bellows portion 51 is contracted after the pressing portion 53*a* of the liquid supply pump 5 is pressed to the contact 101 on the apparatus body 10 to when the bellows portion 51 returns to its original shape, needs to be considered. As illustrated in FIG. 12, the feeler sensor 103 is preferably disposed at a position detectable of the feeler 151 before the pressing portion 53*a* of the liquid supply pump 5 is pressed to the contact 101 on the apparatus body 10.

In addition, it is configured such that the carriage position Pa in a state in which there is residual ink inside the main tank is detected and stored in memory when the main tank is replaced with a new one.

In addition, there is the one applied with a structure in which a consumed amount of the liquid discharged from the printhead is calculated by counting a number of droplets, multiplying the number of droplets by each droplet amount, and by accumulating the possible ink amount to be consumed in the maintenance, and the like, and the liquid consumption is stored in the memory means of the main tank.

In this case, when it is determined that the calculated residual ink amount inside the main tank considering the accumulated error amount is larger than a near-end state, to be described later, it is considered that the residual ink amount is enough and the carriage position at that time is stored in memory as the carriage position Pa when there is ink remaining in the main tank.

Figure 16:
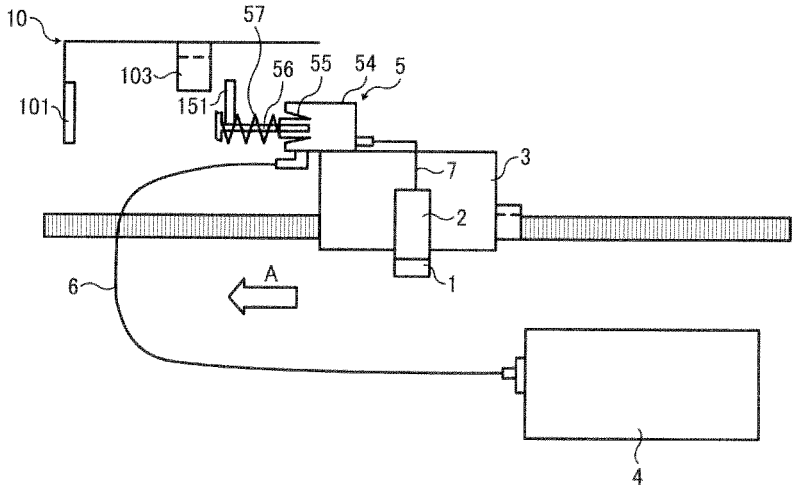
FIG. 16 is a schematic view of a liquid supply device according to an eleventh embodiment of the present invention.

Next, referring to FIG. 16, an eleventh embodiment of the present invention will be described. FIG. 16 is a schematic view of the liquid supply device in the image forming apparatus according to the eleventh embodiment of the present invention.

The present embodiment is based on the tenth embodiment that is applied to a structure implemented in the second embodiment using a piston pump, and the feeler 151 is disposed at the rod 56.

With this configuration as well, the same effect as that of the tenth embodiment can be obtained.

Figure 17:
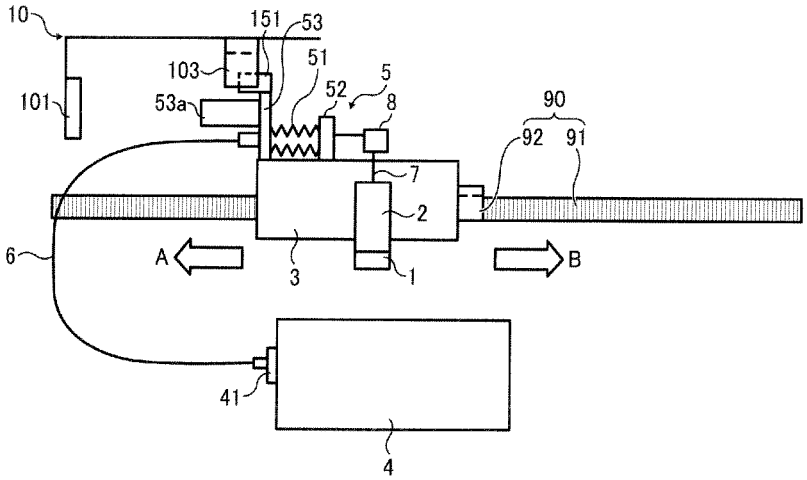
FIG. 17 is a schematic view of a liquid supply device according to a twelfth embodiment of the present invention.

Next, a twelfth embodiment according to the present invention will be described with reference to FIG. 17. FIG. 17 is a schematic view of the liquid supply device in the image forming apparatus according to the twelfth embodiment of the present invention.

The present embodiment is based on the tenth embodiment that is applied to a structure implemented in the fourth embodiment employing the one-way valve 8.

With this configuration as well, the same effect as that of the tenth embodiment can be obtained.

Figure 18:
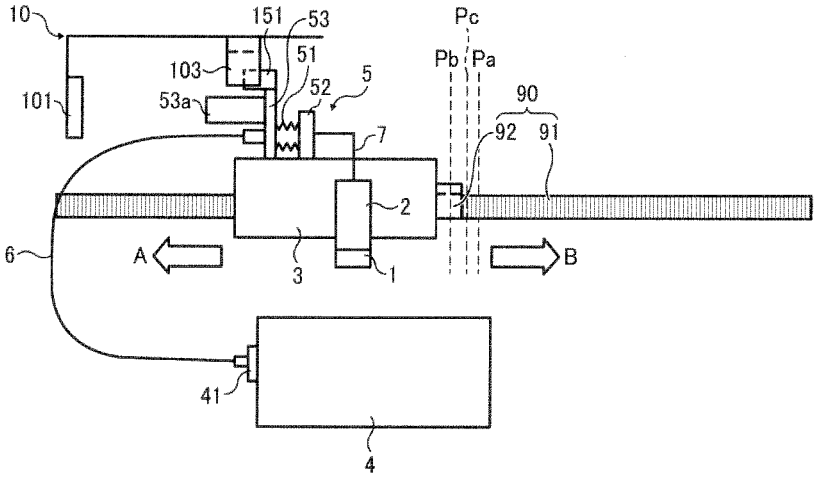
FIG. 18 is a schematic view of a liquid supply device according to a thirteenth embodiment of the present invention.

Next, referring to FIG. 18, a thirteenth embodiment of the present invention will be described. FIG. 18 is a schematic view of the liquid supply device in the image forming apparatus according to the thirteenth embodiment of the present invention.

The present embodiment enables the apparatus to detect both an ink-empty status and a ink-low status.

Figure 19:
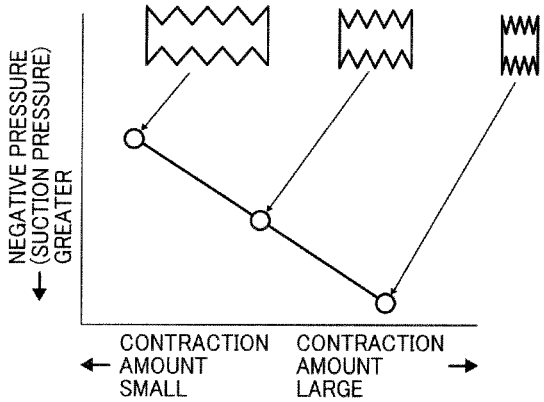
FIG. 19 is a view explaining a relation between a contraction amount of a collapsible portion and a negative pressure.

After supplying liquid by deforming the collapsible portion (i.e., the bellows portion 51) of the liquid supply pump 5, the negative pressure that is generated when the collapsible portion returns to its original shape varies corresponding to a contraction amount as illustrated in FIG. 19. Specifically, the negative pressure or suction force is greater in the most contracted state (that is, the contraction amount is large), and the negative pressure or suction force gradually is weakened as the collapsible portion comes near to the extended state as a restored state (that is, the contraction amount is small).

In this case, when the residual ink amount inside the main tank declines and as the negative pressure inside the main tank increases, it gradually becomes more difficult for the collapsible portion to draw ink from the contracted state and return to the extended state.

Figure 20:
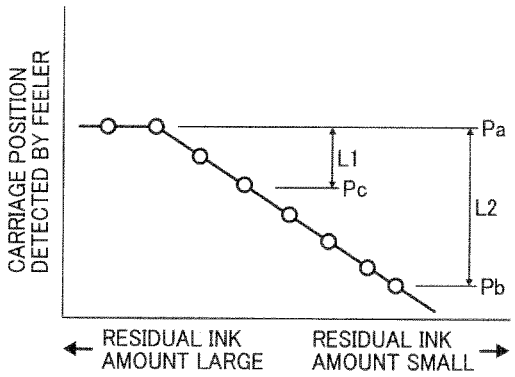
FIG. 20 is an explanatory view of a residual ink amount and the carriage position detected by a feeler.

As illustrated in FIG. 20, a carriage position Pc is an ink-low position having a change amount from the carriage position Pa representing that there is residual ink, of a first threshold amount L1, and the carriage position Pb is an ink-empty position having a change amount from the carriage position Pa, of a second threshold amount L2 (L2>L1).

As a result, both the ink-empty status and the near-end status can be detected.

Figure 21:
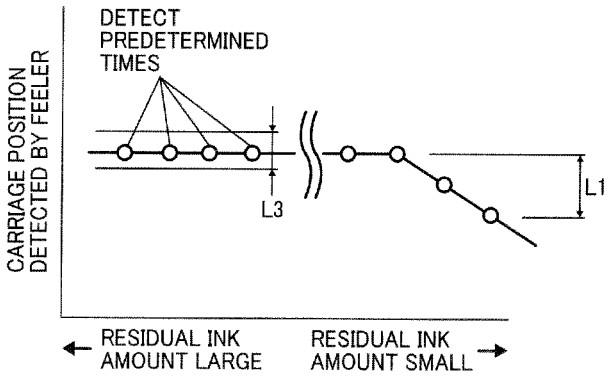
FIG. 21 is a schematic explanatory view related to a fourteenth embodiment of the present invention.

Next, referring to FIG. 21, a fourteenth embodiment of the present invention will be described. FIG. 21 is an explanatory view for explaining the fourteenth embodiment of the present invention.

The present embodiment enables the apparatus to set and memorize the carriage position Pa with residual ink inside the main tank, even though it is not clear how much ink remains in the main tank.

Operation to detect the carriage position when the feeler sensor 103 detects the feeler 151 is repeatedly performed during the image forming operation, and the carriage position is detected by a predetermined number of times. Then, it is determined whether or not a maximum change amount of the carriage position detected by the predetermined number of times is equal to or less than a third threshold amount L3 that is less than the predefined first threshold amount L1 corresponding to the near-end status.

Then, it is determined that the maximum change amount of the carriage position detected by the predetermined number of times is equal to or less than the third threshold amount L3, any one of the carriage positions detected by the predetermined number of times is stored in memory as the carriage position Pa with the residual ink inside the main tank.

The third threshold amount L3 at that time is used as the amount obtained by considering the positional detection error of the carriage, feeler detection error, and individual variation of the extension/contraction operation of the collapsible portion.

With this configuration, the carriage position Pa with residual ink to be used as a reference in detecting the residual ink amount can be set and stored in memory, even though it is not clear how much ink remains in the main tank.

Figure 22:
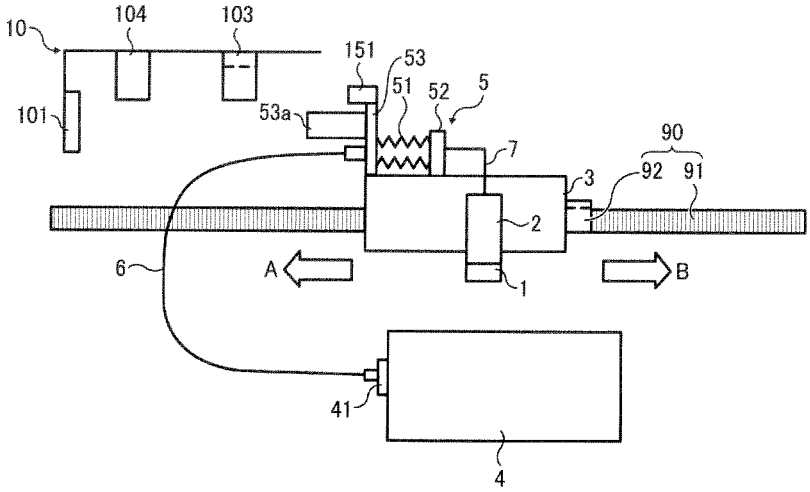
FIG. 22 is a schematic explanatory view related to a fifteenth embodiment of the present invention.

Next, referring to FIG. 22, a fifteenth embodiment of the present invention will be described. FIG. 22 is a schematic view of the liquid supply device in the image forming apparatus according to the fifteenth embodiment of the present invention.

The present embodiment employs a temperature sensor 104 as a temperature/humidity sensor to detect temperature and humidity of the image forming apparatus.

Next, the residual ink amount detection operation according to the fifteenth embodiment will be described referring to flowcharts of FIGS. 23A and 23B.

Figure 23A:
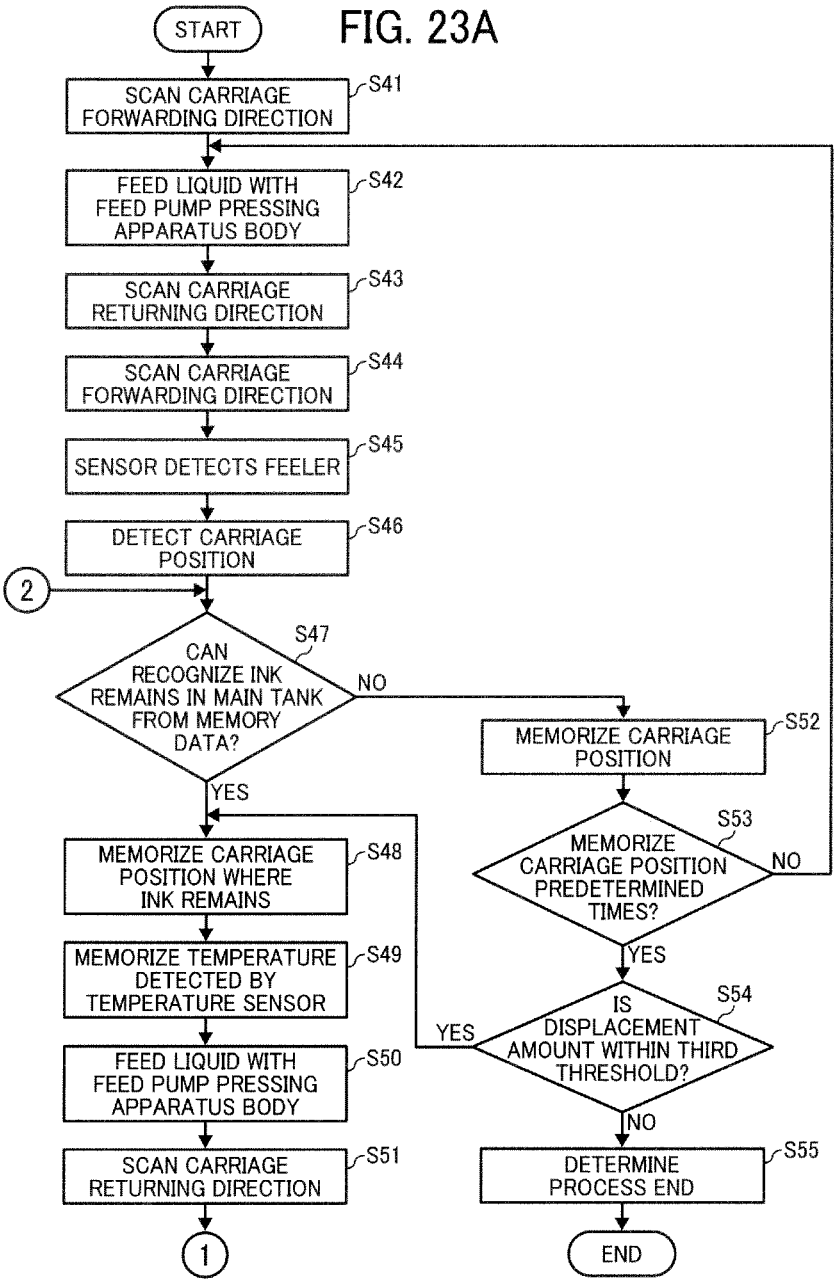
FIG. 23A is a flowchart of a residual ink amount detection operation according to the fifteenth embodiment of the present invention.

First, referring to FIG. 23A, the carriage 3 scans in the to-and-fro direction (in the direction of arrow A as illustrated heretofore) (in Step S41), and the liquid supply pump 5 is pressed against the contact 101 on the apparatus body 10, to thus supply liquid (S42). Thereafter, the carriage 3 scans in the returning direction (in the direction of arrow B as described above) (S43). Then, the carriage 3 scans in the forwarding direction (S44), and the carriage position when the feeler sensor 103 detects the feeler 151 is detected (S45, S46).

Thereafter, it is determined whether or not the residual ink amount is present in the main tank can be determined from the data stored in memory in the memory means of the main tank (that is, the ink cartridge 4) (S47).

When it is not determined that the residual ink amount is present (NO in S47), the detected carriage position is stored in memory (S52), and it is determined whether or not the carriage position is stored in memory by a predetermined number of times (S53). If the carriage position is not stored in memory by the predetermined number of times (NO in S53), the process returns to S42 in which the liquid supply pump 5 is pressed against the contact 101 on the apparatus body 10, to thus supply liquid (S42).

When the carriage position is stored in memory by the predetermined number of times (YES in S53), whether or not displacement amounts of the carriage positions detected by the predetermined number of times are equal to or less than the third threshold amount is determined (S54).

Herein, when the carriage positions detected by the predetermined number of times are not the same, it is determined to be the ink-empty status (S55), and the process ends.

By contrast, when the carriage positions detected by the predetermined number of times are the same (YES in 54), the process moves on to a process in which the residual ink amount is present in the main tank from the data stored in memory in the memory means of the main tank.

Then, when it can be determined that the residual ink amount is present (YES in S47), the detected carriage position is stored in memory as the carriage position where the ink remains (S48).

Thereafter, the temperature sensor 104 detects a temperature and the detected temperature is stored in memory as a detection environment (S49).

The liquid supply pump 5 is pressed against the contact 101 on the apparatus body 10 (S50) to supply liquid, and the carriage 3 moves to scan in the returning direction (S51).

Figure 23B:
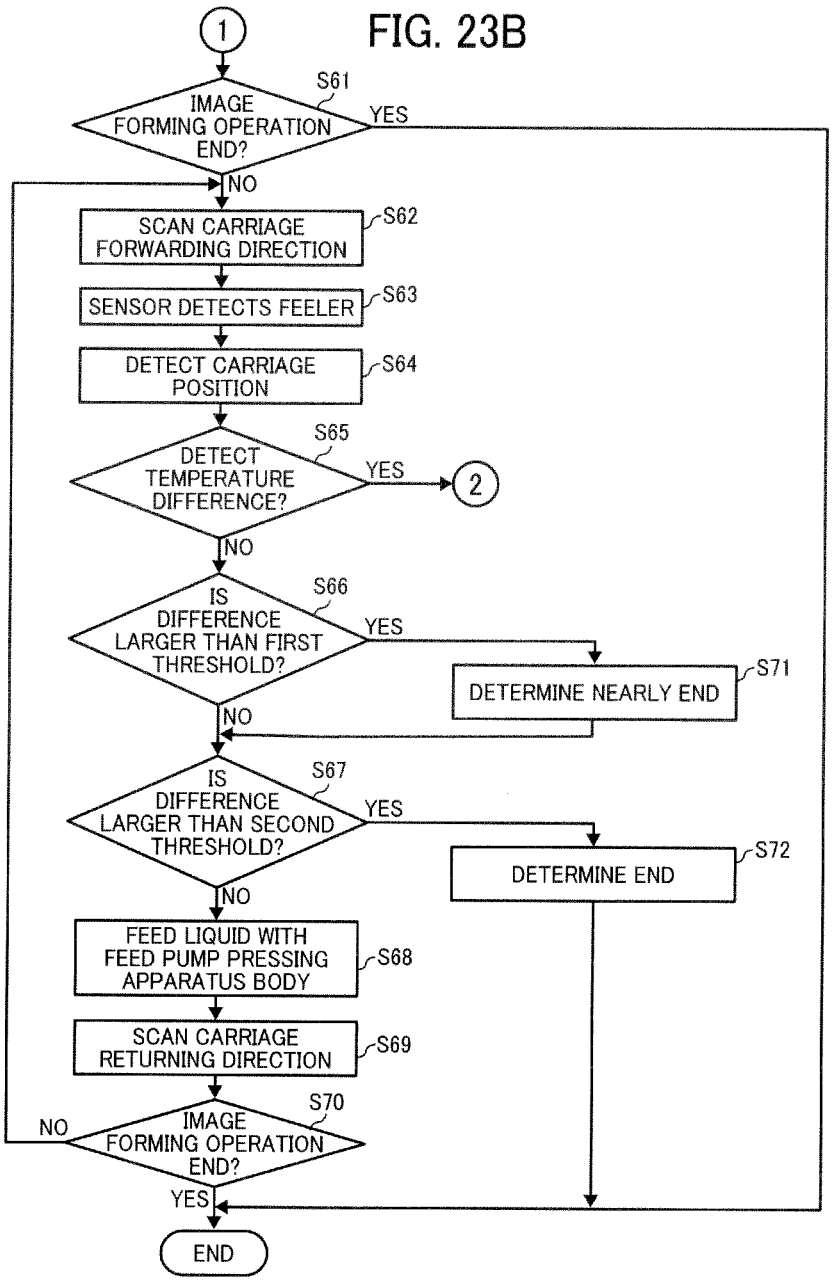
FIG. 23B is a flowchart of a process successive to the process of FIG. 23A.

Then, the process moves to a process as illustrated in FIG. 23B, whether or not the image forming operation ends is detected (S61), and if YES in S61, the process ends.

On the other hand, if the image forming operation does not end (NO in S61), the carriage 3 scans in the forwarding direction (S62), and the carriage position when the feeler sensor 103 detects the feeler 151 is detected (S63, S64).

Then, whether the difference between the temperature obtained by the temperature sensor 104 and the stored in memory one is equal to or more than the predetermined temperature difference (S65) is determined.

In this case, if the difference between the detected temperature and the stored in memory temperature is higher than the predetermined temperature difference (YES in S65), the process returns to S47 in which whether or not the residual ink amount is present in the main tank can be determined from the data stored in memory in the memory means of the main tank (S47).

By contrast, when the difference between the detected temperature and the stored in memory temperature is not higher than the predetermined temperature difference (NO in S65), whether or not the difference/variation between the stored in memory carriage position and the detected carriage position is larger than the first threshold is determined (S66).

If the variation is larger than the first threshold (YES in S66), it is determined that the status is when the ink nearly ends (S71).

By contrast, when the variation is not larger than the first threshold (NO in S66), whether or not the variation is larger than the second threshold is determined (S67).

Then, if the variation is larger than the second threshold (YES in S67), it is determined that the status is when the ink runs out (S72).

On the other hand, if the variation is not larger than the second threshold (NO in S67), the liquid supply pump 5 is pressed against the contact 101 on the apparatus body 10 (S68), and the carriage 3 moves to scan in the returning direction (S69).

Then, whether the image forming operation ends or not is determined (S70). Then, when the image forming operation does not end (NO in S70), the process returns to a process in Step S62 and the carriage 3 scans in the forwarding direction (S62). When the image forming operation ends (YES in S70), the process ends.

Specifically, in the present embodiment, the image forming apparatus includes a temperature sensor. When it is determined that the liquid remains in the main tank, and the temperature detected by the temperature sensor when the carriage position is detected by the feeler sensor detecting the feeler is stored in memory, and thereafter, when a predetermined temperature difference is detected from the detected temperature stored in memory during the image forming operation, the carriage position is again stored in memory when, by the feeler sensor detecting the feeler, it is determined that the residual ink is present.

With this structure, the detection error due to variations in the collapsible amount of the collapsible portion due to changes in the environmental temperature can be reduced.

Figure 24:
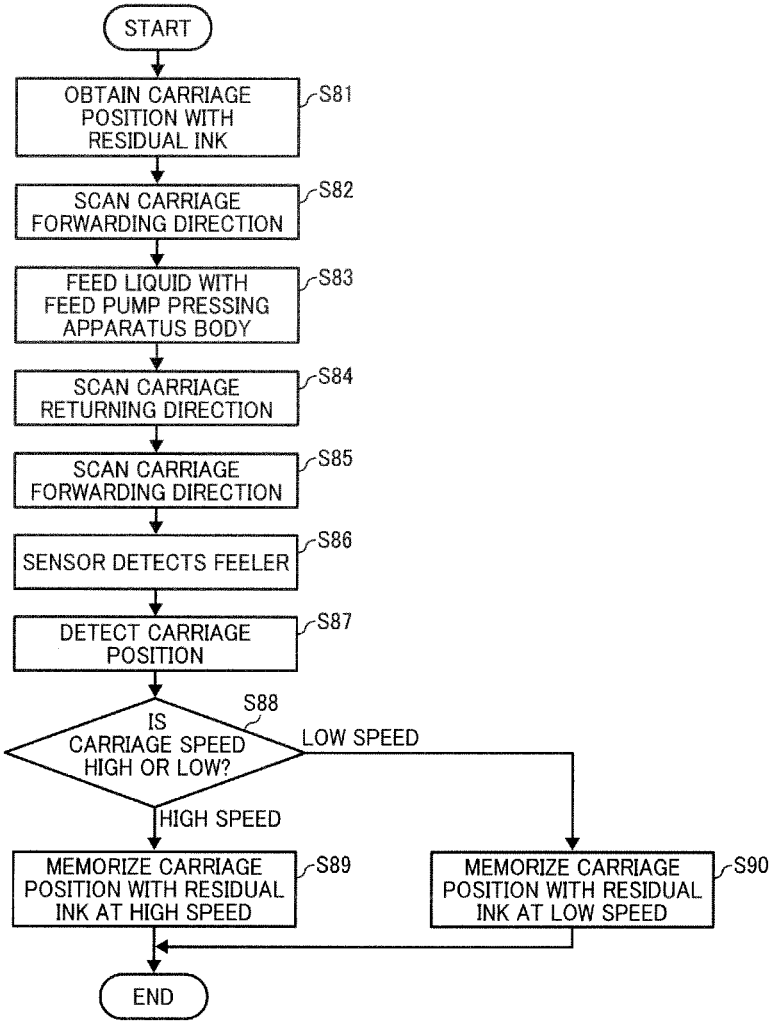
FIG. 24 is a flowchart to explain memorization of the carriage position for use in the residual ink amount detection operation according to a sixteenth embodiment of the present invention.

Next, referring to FIG. 24, a sixteenth embodiment of the present invention will be described. FIG. 24 is a flowchart to explain memorization of the carriage position for use in the residual ink amount detection operation according to a sixteenth embodiment of the present invention.

In the present embodiment, operation to obtain the carriage position when residual ink is present is started (S81), the carriage 3 scans in the forwarding direction (S82), and the liquid supply pump 5 is pressed against the contact 101 on the apparatus body 10, to thus supply liquid (S83). Thereafter, the carriage 3 scans in the returning direction (S84). Then, the carriage 3 scans in the forwarding direction (S85), and the carriage position when the feeler sensor 103 detects the feeler 151 is detected (S86, S87).

Then, whether the carriage speed is high or low is determined (S88). If the carriage speed is high (see HIGH SPEED), the carriage position is stored in memory as a state in which the residual ink is present at a high speed (S89). If the carriage speed is low (see LOW SPEED), the carriage position is stored in memory as a state in which the residual ink is present at a low speed (S90).

Specifically, due to changes in the printing conditions in the image formation such as the carriage scanning speed and the carriage scanning area, the carriage to-and-fro scanning time changes. In such a case, a control to change the first threshold amount or the second threshold amount is needed.

For example, when the carriage scanning speed is different between the high speed and the low speed, the time to take in which the carriage scans one round is shorter when the carriage scanning speed is high than when the carriage scanning speed is low after the liquid supply pump is pressed against the contact on the apparatus body. Then, the time to detect that the collapsible portion returns to its original shape from the contracted state becomes shorter. Thus, the carriage position detected by the feeler sensor to detect the feeler is different depending on the carriage scanning speed of "high speed" and "low speed."

A proper determination can be performed as follows: the carriage positions different from the "high speed" and the "low speed" are stored in memory in relation to the carriage moving speed, and the variations of the carriage position during the image formation is determined based on the carriage positions corresponding to the high and low speeds, respectively.

Then, the time to detect whether or not the collapsible portion returns to its original shape from the contracted state becomes shorter and the displacement distance becomes shorter when the carriage speed is high compared to when the carriage speed is low. Thus, the change in the carriage position detected by the feeler sensor to detect the feeler becomes smaller in the "high speed" than the "low speed."

Thus, the first threshold to determine that the ink nearly ends and the second threshold to determine that the ink runs out are preferably set to different values.

As to the first threshold and the second threshold, for example, if there is provided a control to change the distance to press against the contact on the apparatus body, that is, the deformation amount of the collapsible portion, it is preferred that the carriage position stored in memory as a state in which there is residual ink inside the main tank, the first threshold amount, and the second threshold amount be changed.

Specifically, for example, in forming images, the ink amount discharged from the printhead during one reciprocal scanning movement of the carriage is previously calculated, and, if it is determined that the ink amount to be supplied from the liquid supply pump to the sub tank may be small, the deformation amount of the collapsible portion is changed to a small amount. That is, the scanning amount of the carriage when the liquid supply pump is pressed against the contact on the apparatus body is shortened.

Thus, the collapsible portion is controlled such that the collapsible portion need not always be deformed maximally, so that the negative pressure or load to the collapsible portion is decreased and the lifetime of the liquid supply pump can be longer.

In this case, the scanning amount of the carriage is shortened. Along with this, the carriage position stored in memory as a state in which there is residual ink inside the main tank, the first threshold amount, and the second threshold amount are changed or corrected, so that determination of the ink-empty state can be appropriately performed.

Figure 25:
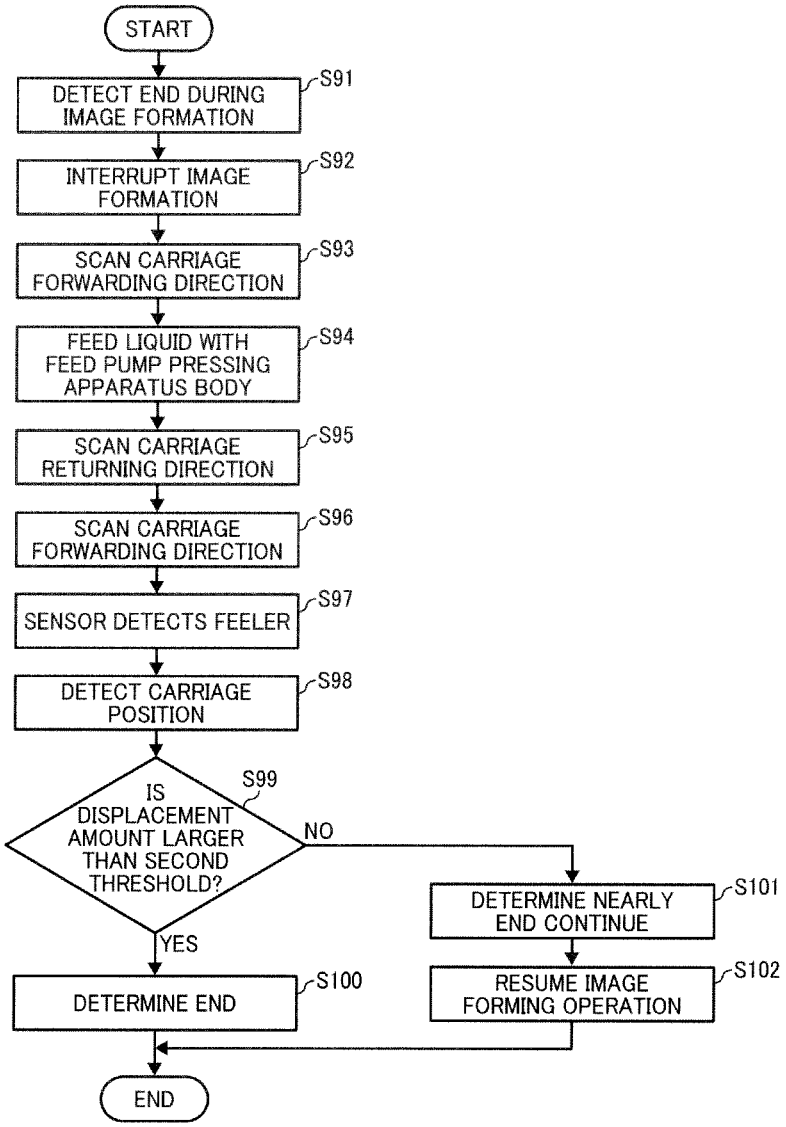
FIG. 25 is a flowchart of a residual ink amount detection operation according to a seventeenth embodiment of the present invention.

Next, a seventeenth embodiment according to the present invention will be described with reference to FIG. 25. FIG. 25 is a flowchart of a residual ink amount detection operation according to the seventeenth embodiment of the present invention.

In the present embodiment, when an ink-empty state is detected during the image forming operation (S91), the image forming operation is interrupted (S92).

Then, the carriage 3 scans in the forwarding direction (S93), and the liquid supply pump 5 is pressed against the contact 101 on the apparatus body, to thus supply liquid (S94). Thereafter, the carriage 3 scans in the returning direction (S95). Then, the carriage 3 scans in the forwarding direction (S96), and the carriage position when the feeler sensor 103 detects the feeler 151 is detected (S97, S98).

Thereafter, whether or not the displacement amount of the carriage position is larger than the second threshold amount is determined (S99).

In this case, when the variation of the carriage position is larger than the second threshold, it is determined that the ink runs out (S100).

By contrast, when the variation of the carriage position is not larger than the second threshold (NO in S99), it is determined that the ink nearly ends (S101), and the image forming operation is resumed (S102).

Specifically, in the present embodiment, when the displacement amount of the carriage position exceeds the second threshold during the image forming operation and an ink-empty state is detected, the image forming operation is interrupted and whether the ink runs out or not is detected again.

This is a fail-safe operation to determine that the ink-end is detected erroneously when the carriage scans and the feeler is detected, due to effects of other image forming operation such as vibration given to the carriage, and the like. With this structure, a hasty replacement of the main tank with a new one can be prevented even when the ink remains inside the main tank due to an erroneous detection of an ink-empty state.

Figure 26:
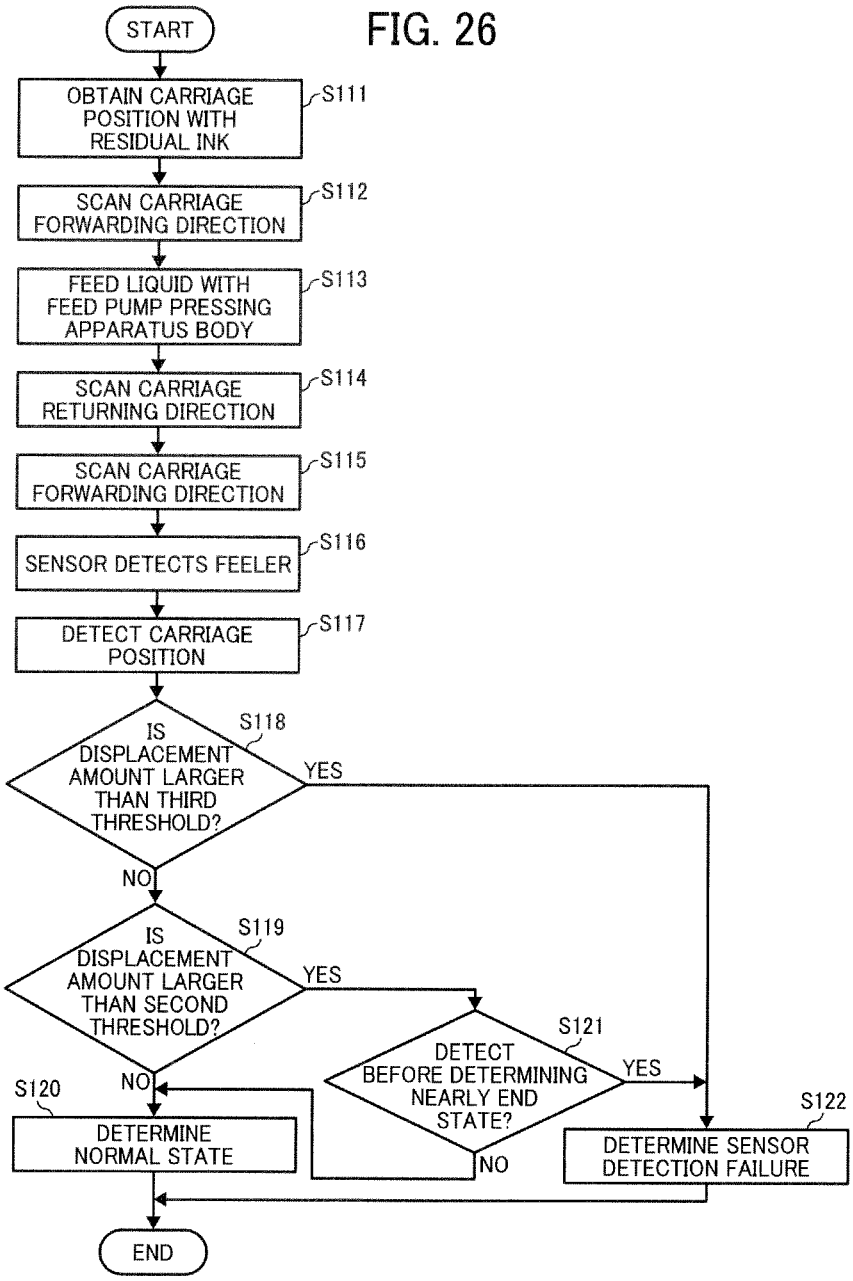
FIG. 26 is a flowchart of a residual ink amount detection operation according to an eighteenth embodiment of the present invention.

Next, an eighteenth embodiment according to the present invention will be described with reference to FIG. 26. FIG. 26 is a flowchart of a residual ink amount detection operation according to the eighteenth embodiment of the present invention.

In the present embodiment, first, the carriage position in a state in which there is residual ink inside the main tank is obtained and stored in memory (S111).

Then, the liquid supply pump 5 is pressed against the contact 101 on the apparatus body 10, to supply liquid, and the carriage 3 moves to scan in the returning direction (S112 to S114).

Thereafter, the carriage 3 scans in the forwarding direction (S115), and the carriage position when the feeler sensor 103 detects the feeler 151 is detected (S116, S117).

Then, whether or not the displacement amount of the carriage position is larger than the third threshold amount is determined (S118).

In this case, when the variation of the carriage position is larger than the third threshold (YES in S118), it is determined that the sensor detection failure occurs (S122).

Specifically, if the ink inside the ink cartridge 4 gradually diminishes, the position where the contracted bellows portion 51 returns an original shape is normally reduced gradually. Based on the fact, when the ink gradually declines and the bellows portion 51 changes with a gradually reducing change amount, it is determined that the bellows portion 51 returns to its original shape suddenly as in a state in which ink remains by the carriage position detection operation.

Specifically, when the ink is not supplied to the bellows portion 51, and the bellows portion 51 is negatively pressurized and cannot return to its original shape, if the negative pressure inside the bellows portion 51 is released to air by a sudden hole happened to a surface of the bellows portion 51, the bellows portion 51 returns to the original shape. Therefore, when it is detected from the carriage position detection that the bellows portion 51 returns to its original shape, it is determined that the sensor detection failure occurs.

Herein, when the bellows portion 51 displaces in the direction opposite the direction (i.e., the restoring direction) in which the bellows portion 51 is contracting, if the bellows portion 51 displaces more than the third threshold being a detection error range, it is determined that an abnormal operation occurs.

By contrast, when the variation is not larger than the third threshold (NO in S118), whether or not the variation is larger than the second threshold is determined (S119).

In this case, when the variation of the carriage position is not larger than the second threshold (YES in S119), it is determined that the sensor detects normally (S120).

By contrast, when the variation is larger than the second threshold (YES in S119), whether or not the variation is detected before the ink low is determined (S121).

If the variation is not detected before the ink low is determined (NO in S121), it is determined that the sensor detects normally (S120). However, the variation is detected before the ink low is determined (YES in S121), it is determined that the sensor detection failure occurs (S122).

That is, by determining a displacement process of the carriage position when the feeler is detected, abnormal detection of the carriage position and of the feeler sensor can be detected.

For example, because it can be detected that the residual amount inside the main tank is gradually reducing before the ink runs out, if the variation of the carriage position exceeds the second threshold is detected before detecting that the variation of the carriage position exceeds the first threshold, it means that a drastic change in the carriage position is detected, so that it can be determined that the carriage position detection error occurs.

In addition, from the carriage position when it is determined that there is the residual ink inside the main tank, when the carriage position is detected in the direction opposite the direction in which the ink residual amount is reducing, the change in the displacement or variation is caused by the effect of vibration in the carriage scanning, or is larger than the third threshold within the allowable detection error such as the feeler sensor detection error, it can be determined that the carriage position detection error occurs.

Thus, by detecting the carriage position detection error, it can be determined whether the collapsible portion of the liquid supply pump is damaged, for example. That is, when the collapsible portion of the liquid supply pump is damaged, the collapsible portion contracted due to the liquid supply operation returns to an original state in a short time of period upon the air is drawn. Therefore, by observing the process that the carriage position varies, damage to the liquid supply pump can be detected.

With this structure, before critical damage occurs to the image forming apparatus such as ink leakage from the liquid supply pump, operation of the apparatus can be interrupted.

In the present application, the term "sheet" is not limited to paper materials, but also includes a OHP sheet, fabrics, glass, board, and the like, on which ink droplets or other liquid can be adhered. The term "sheet" includes a recorded medium, recording medium, recording sheet, and the like. The term "image formation" means not only recording, but also printing, image printing, and the like.

Herein, the term "image forming apparatus" means an apparatus to perform image formation by impacting ink droplets onto various media such as paper, thread, fiber, fabric, leather, metals, plastics, glass, wood, ceramics, and the like. "Image formation" means not only forming images with letters or figures having meaning to the medium, but also forming images without meaning such as patterns to the medium (and simply impacting the droplets to the medium).

Herein, the term "ink" is not limited to so-called ink, but means and is used as an inclusive term for every liquid such as recording liquid, fixing liquid, and aqueous fluid to be used for image formation, which further includes, for example, DNA samples, registration and pattern materials and resins.

The term "image" is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an apparatus body;

a printhead to discharge droplets;

a sub tank to hold a liquid to be supplied to the printhead for discharge as droplets;

a carriage movable in a carriage scanning direction for scanning, including the printhead and the sub tank;

a main tank to contain the liquid to be supplied to the sub tank;

a liquid supply pump to supply the liquid from the main tank to the sub tank;

a first liquid supply tube that connects the main tank to an inlet portion, disposed at one end in the carriage scanning direction, of the liquid supply pump; and a second liquid supply tube that connects the sub tank to an outlet portion, disposed at an opposite end opposite in the carriage scanning direction to the one end, of the liquid supply pump, wherein a fluid resistance of the first liquid supply tube is greater than a fluid resistance of the second liquid supply tube, and wherein the liquid supply pump includes a deformable portion that shrinks and expands in the carriage scanning direction, by scanning movement of the carriage, to take the liquid in from the main tank through the inlet portion at the one end of the liquid supply pump and pump the liquid out to the sub tank through the outlet portion at the opposite end of the liquid supply pump, and the volume of liquid supplied to the sub tank being greater than the volume of liquid supplied to the main tank when the liquid supply pump supplies the liquid to the sub tank.

2. The image forming apparatus as claimed in claim 1, wherein the first liquid supply tube and the second liquid supply tube have the same cross-sectional area in a direction perpendicular to a direction of flow of the liquid, and the first liquid supply tube is longer than the second liquid supply tube.

3. The image forming apparatus as claimed in claim 1, further comprising a contact disposed on the apparatus body, wherein the liquid supply pump is disposed on the carriage and comprises a pressing portion configured to be pressed against the contact, wherein, when the carriage moves toward the contact, the pressing portion of the liquid supply pump is pressed against the contact, so that the deformable portion contracts and an internal volume is reduced to expel the liquid.

4. The image forming apparatus as claimed in claim 1, further comprising a one-way valve, disposed in the second liquid supply tube, to prevent the liquid from flowing from the sub tank to the liquid supply pump.

5. The image forming apparatus as claimed in claim 1, wherein the sub tank comprises a valve that opens when pressure inside the sub tank exceeds a predetermined negative pressure, and closes when the negative pressure inside the sub tank decreases below the predetermined negative pressure.

6. The image forming apparatus as claimed in claim 1, wherein the carriage moves to scan and the liquid supply pump supplies liquid when image formation is not performed.

7. The image forming apparatus as claimed in claim 1, wherein the carriage moves to scan and the liquid supply pump supplies liquid after an image forming operation is complete.

8. The image forming apparatus as claimed in claim 1, further comprising a gauge that measures an amount of liquid that the printhead discharges and consumes, wherein the liquid supply pump supplies liquid when the measured amount exceeds a predetermined threshold amount.

9. An image forming apparatus comprising:

an apparatus body;

a printhead to discharge droplets;

a sub tank to hold a liquid to be supplied to the printhead for discharge as droplets;

a movable carriage for scanning, including the printhead and the sub tank;

a main tank to contain the liquid to be supplied to the sub tank;

a liquid supply pump to supply the liquid from the main tank to the sub tank;

a first liquid supply tube that connects the main tank to the liquid supply pump; and a second liquid supply tube that connects the liquid supply pump to the sub tank, wherein a fluid resistance of the first liquid supply tube is greater than a fluid resistance of the second liquid supply tube, and wherein the liquid supply pump includes a deformable portion that shrinks and expands in a carriage scanning direction, by scanning movement of the carriage, to take the liquid in and pump the liquid out, and the volume of liquid supplied to the sub tank being greater than the volume of liquid supplied to the main tank when the liquid supply pump supplies the liquid to the sub tank;

a feeler disposed on the deformable portion of the liquid supply pump; and a feeler sensor to detect the feeler, disposed on the apparatus body, wherein an amount of liquid remaining inside the main tank and still available to be supplied from the main tank is detected from a variation in carriage position detected when the feeler sensor detects the feeler.

10. The image forming apparatus as claimed in claim 9, wherein the feeler sensor detects the feeler after the liquid supply pump supplies the liquid to the sub tank.

11. The image forming apparatus as claimed in claim 9, further comprising a contact disposed on the apparatus body, wherein the liquid supply pump is disposed on the carriage and comprises a pressing portion configured to be pressed against the contact, wherein the feeler sensor is disposed on the apparatus body at a position where the feeler sensor can detect the feeler before the pressing portion of the liquid supply pump presses against the contact on the apparatus body as the carriage moves to scan in the carriage scanning direction in which the liquid supply pump supplies the liquid to the sub tank.

12. The image forming apparatus as claimed in claim 9, further comprising a memory device in which to store the carriage position when the feeler sensor detects the feeler when the carriage is moved to scan in the carriage scanning direction which is parallel to a direction in which the liquid supply pump supplies liquid, wherein a difference between the carriage position stored in the memory device and a carriage position detected when the feeler sensor detects the feeler during image formation by the image forming apparatus defines the variation in carriage position.

13. The image forming apparatus as claimed in claim 12, wherein, after the carriage position when the feeler sensor detects the feeler is detected and stored in the memory device, the carriage position is detected a predetermined number of times and the detected carriage positions are stored in the memory device, wherein, upon determining that a maximum change amount of the carriage position detected by the predetermined number of times is less than a predetermined first threshold amount corresponding to a liquid-low status, any one of the carriage positions stored in the memory device is set as a carriage position in which there is residual liquid inside the main tank, and a difference between the any one of the carriage positions stored in the memory device in a state in which there is residual liquid inside the main tank and the carriage position detected when the feeler sensor detects the feeler during image formation defines the variation in carriage position.

14. The image forming apparatus as claimed in claim 13, wherein, when a displacement amount between the carriage position stored in the memory device and the carriage position detected when the feeler sensor detects the feeler is larger than a predetermined second threshold corresponding to a liquid-empty status, it is determined that the residual liquid inside the main tank ends, and when the displacement amount is larger than the predetermined first threshold, less than the second threshold, corresponding to the liquid-low status, it is determined that the residual liquid inside the main tank nearly ends.

15. The image forming apparatus as claimed in claim 14, wherein, if the variation between the carriage position stored in the memory device and the carriage position when the feeler sensor detects the feeler during the image formation is larger than the predetermined second threshold corresponding to the liquid-empty status, it is determined that there is no residual liquid inside the main tank.

16. The image forming apparatus as claimed in claim 12, further comprising a temperature/humidity sensor to detect temperature and humidity, wherein readings are stored in the memory device when the feeler sensor detects the feeler, and when a variation from the stored in the memory device is larger than a predetermined threshold, a carriage position in a state in which there is residual liquid inside the main tank is detected again and stored in the memory device.

17. The image forming apparatus as claimed in claim 12, wherein a carriage position when there is residual liquid inside the main tank is stored in the memory device in relation to moving speed of the carriage.

18. The image forming apparatus as claimed in claim 13, wherein, when a contraction amount of the deformable portion of the liquid supply pump is changed, the first threshold amount and the second threshold amount are changed.

19. The image forming apparatus as claimed in claim 14, wherein, when it is determined that the liquid runs out during an image forming operation, the image forming operation is interrupted and an operation to determine whether or not the liquid runs out is performed by detecting the carriage position again.

20. The image forming apparatus as claimed in claim 13, wherein, when it is detected that the variation is larger than the second threshold before determining that the variation is larger than the first threshold, it is determined that an abnormal operation occurs.

* * * * *